United States Patent [19]

Englemann

[11] Patent Number: 4,995,843

[45] Date of Patent: Feb. 26, 1991

[54] SURFBOARD

[76] Inventor: Dirk Englemann, Am Fuchsbau 5, D-1000 Berlin 27, Fed. Rep. of Germany

[21] Appl. No.: 273,816

[22] PCT Filed: Mar. 19, 1987

[86] PCT No.: PCT/DE87/00121

§ 371 Date: Sep. 16, 1988

§ 102(e) Date: Sep. 16, 1988

[87] PCT Pub. No.: WO87/05526

PCT Pub. Date: Sep. 24, 1987

[30] Foreign Application Priority Data

Mar. 21, 1986 [DE] Fed. Rep. of Germany ..... 3610043
Oct. 17, 1986 [DE] Fed. Rep. of Germany ..... 3635802

[51] Int. Cl.[5] ..... A63C 15/00
[52] U.S. Cl. ..... 441/74; 441/79
[58] Field of Search ..... 114/39.1, 284, 285, 114/286, 287, 271, 279; 441/65, 74, 79

[56] References Cited

U.S. PATENT DOCUMENTS 3,902,207 9/1975 Tinkler et al. ..... 441/74
3,988,794 11/1976 Tinkler et al. ..... 441/74

*Primary Examiner*—Joseph F. Peters, Jr.
*Assistant Examiner*—Edwin L. Swinehart
*Attorney, Agent, or Firm*—Mark P. Stone

[57] ABSTRACT

The present invention provides a surfboard which includes, in the lower aft region, a vertically narrow flexible tongue, the bending range of which is restricted by an elastic device, and, in the upper aft region, a covering material. Two supports are arranged one behind the other in the surfboard's longitudinal direction. A rear support is secured to the tongue, and a forward support is located in the region of the forward end of the tongue or in front of the tongue. A stringer is provided for elastically connecting the front and rear supports. The surfboard provides a simple and space-saving design.

21 Claims, 3 Drawing Sheets

SURFBOARD

Figure 1:
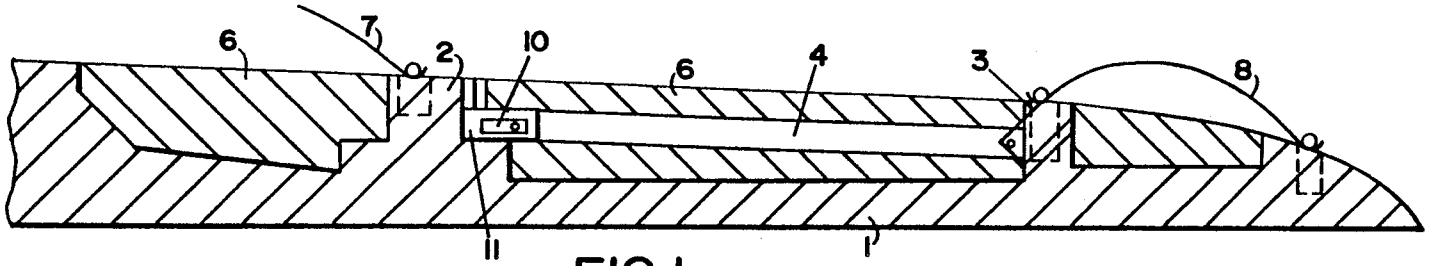

The invention relates to a surfboard, the aft region of which has underneath a vertically narrow flexible tongue, of which the bending-up range is limited by an elastic device, and has covering material on top.

The property of such a board is that, when it moves straight ahead, when the surfer's weight is partially absorbed by his arms because of the leaning posture, it (substantially) maintains its originally predetermined shape, but during turning, when the surfer can exert more pressure on the board, the aft of the board bends up, thus making turning easier.

In a known board of this type (U.S. Pat. No. 3,902,207), the elastic device is a two-armed lever which has a fulcrum fixed to the board and of which one arm is supported on the tongue and the other arm on an elastic stop element acting in the vertical direction. This device is relatively complicated and takes up considerable space in the vertical direction.

The object on which the invention is based is to design the surfboard defined in the introduction, in such a way that it is made simpler than the known surfboard and takes up less space in the vertical direction.

According to the invention, this object is achieved by means of two stays which are arranged in succession in the longitudinal direction of the surfboard and of which that at the rear is fastened to the tongue and that at the front is located in the region of the front tongue end or preceding this, and by means of a stringer which is intrinsically elastic in the longitudinal direction of the board or is mounted elastically and which is arranged between the twso stays.

The design according to the invention, in comparison with the knwon design, is characterized by greater simplicity and less space required in the vertical direction.

In a further development of the invention, the space above the tongue is filled with highly elastic material. This affords, among other things, the advantage that the surfer's feet are cushioned, giving him a pleasant feeling.

It is also proposed that there be underneath the stringer plinths which are fixed to the tongue or fixed to the stringer and which end at a short distance from the stringer or tongue. This ensures that a bending of the tongue is limited in the downward direction.

It is expedient furthermore if there are springs between the tongue and the stringer, which springs are preferably adjustable in relation to the spring characteristic. This measure serves to influence the bending line of the tongue when the latter bends upwards or downwards.

Figure 2:
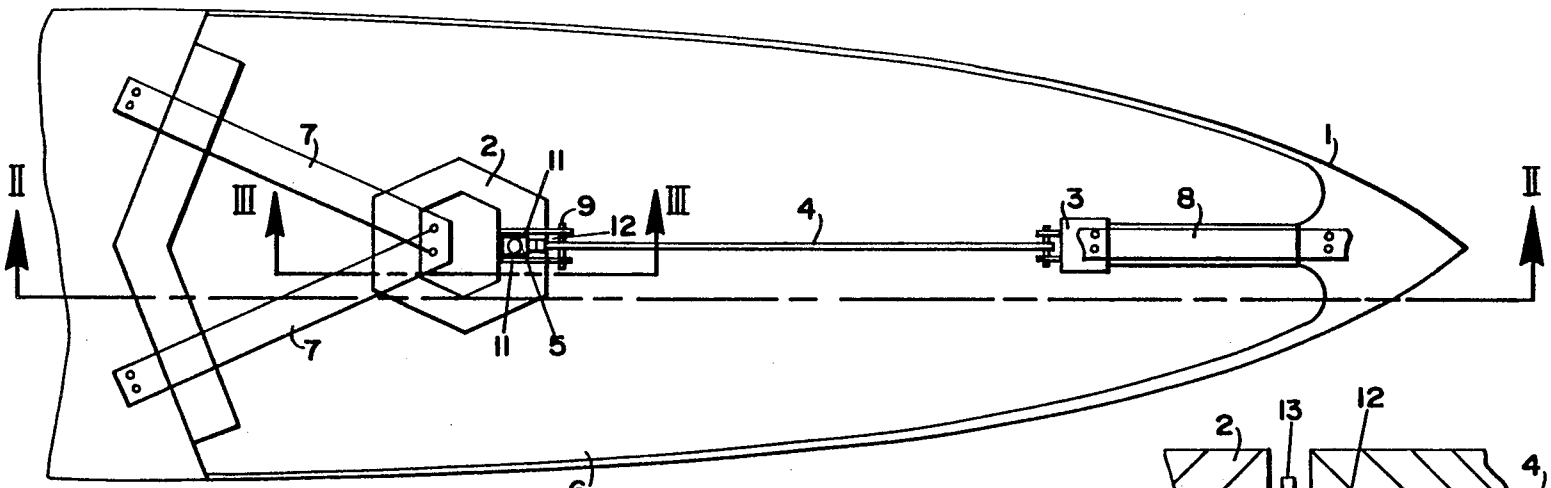
Figure 3:
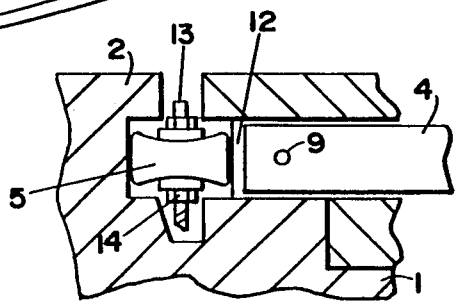
Figure 4:
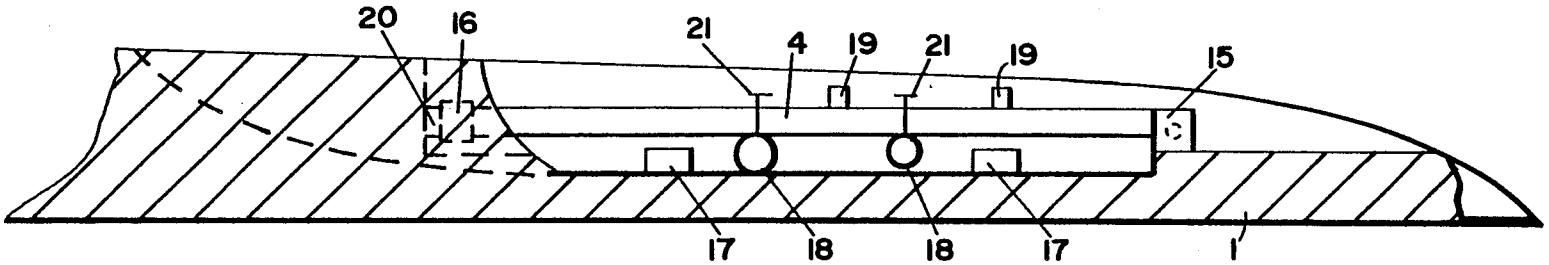
Figure 5:
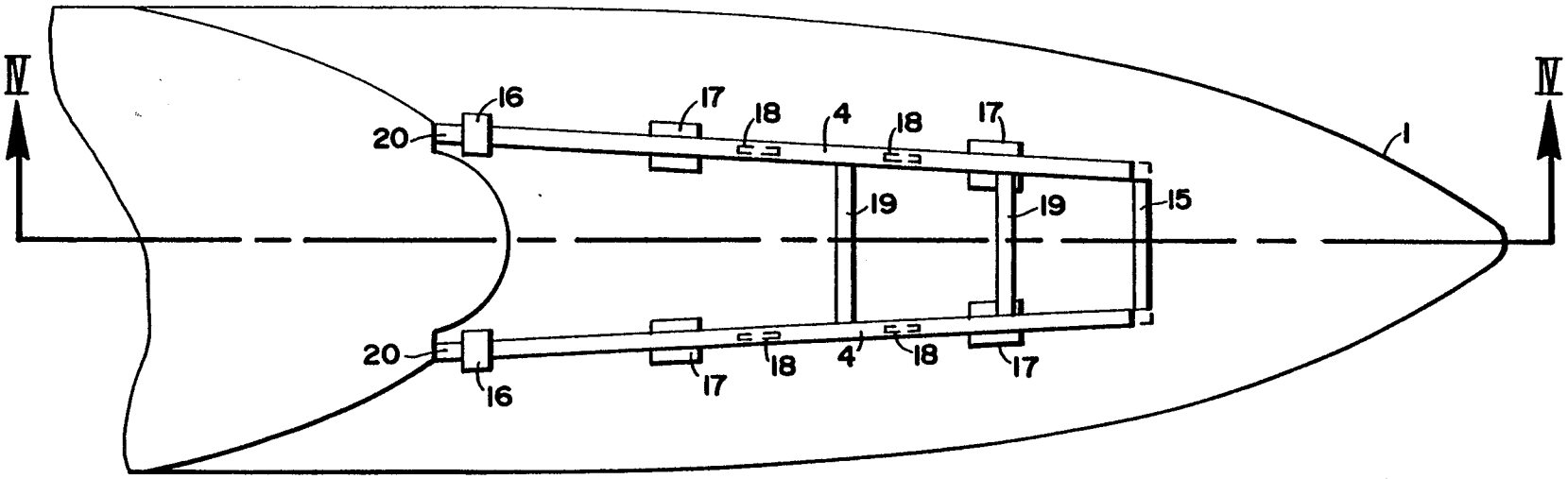
Figure 6:
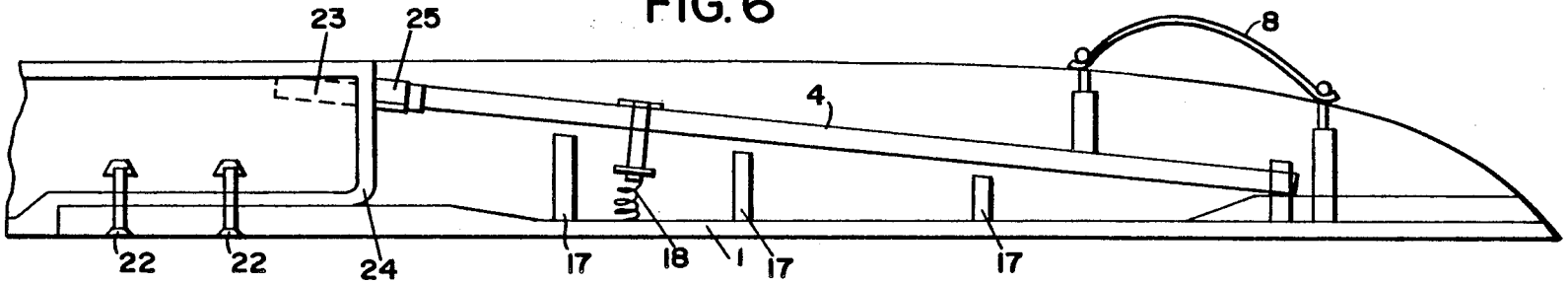
Figure 7:
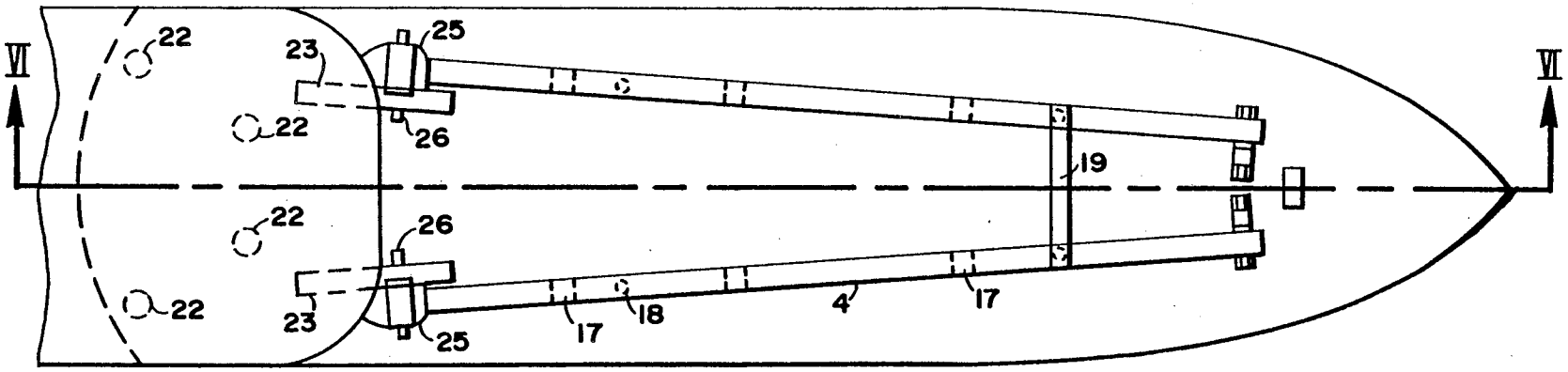

Further details of the invention emerge from the drawing. In this:

FIG. 1 shows a section through a first embodiment of the invention along the line II—II of FIG. 2, FIG. 2 shows a plan view of this first embodiment, FIG. 3 shows a detail in a vertical section, FIG. 4 shows a section through a second embodiment of the invention along the line IV—IV of FIG. 5, FIG. 5 shows a plan view of this second embodiment, FIG. 6 shows a section through a third embodiment of the invention along the line VI—VI of FIG. 7, and FIG. 7 shows a plan of this third embodiment.

FIGS. 1 and 2 show the aft end of a surfboard according to the invention. This comprises a tongue 1, two stays 2 and 3, a strigner 4 clamped between the stays 2 and 3, an elastic buffer 5 between the stringer 4 and the stay 2, highly elastic filling material 6 above the tongue. 1 (the material is omitted in FIG. 2), and loops 7 and 8 for holding the surfer's feet. The elastic filling material 6 is preferably a foam in which at least the outer pores of the foam are closed. The stringer 4 is mounted so as to be longitudinally displaceable relative to the stay 2 via a bolt 9 which is inserted into slots 10 of two brackets 11 fixed to the stay. The stringer 4 is supported, via a plate 12, on the rubber buffer 5 which itself rests against the stay 2 by means of its front end. The rubber buffer 5 thus ensures an elastic mounting of the stringer 4 in the longitudinal direction of the board FIG. 3 shows this mounting in detail. A screw 13 passes through the rubber buffer 5. A nut 14 is arranged on the screw 13. The rubber buffer 5 has a biconvex shape in the non-loaded state. The two convex surfaces can be pressed together by means of the screw 13 and the nut 14. It is thus possible to adjust the elasticity of the rubber buffer 5.

FIGS. 4 and 5 show the aft of another embodiment. This comprises a tongue 1, a bearing arm 15, two stringers 4, two elastic buffers 16, plinths 17 fixed to the tongue, spring rings 18 between the stringers 4 and the tongue 1, and cross-struts 19 between the stringers 4. Each cross-strut 19 is mounted sufficiently loose to the stringers 4 to enable the tongue 1 to bend and twist within predetermined limits. The composite structure comprising the stringer 4 and the buffer 16 is clamped respectively between the bearing arm 15 and a support point 20. The latter is located in a board surface which extends vertically or obliquely. The springs 18 are connected to the stringer by means of screws 21. These screws make it possible to vary the distance between the springs 18 and the stringers 4 and thus adjust the spring force of the springs 18. Two foot loops (not shown) arranged in succession are located between the bearing arm 15 and the adjacent cross-strut 19 on the one hand, and the two cross-struts 19 on the other hand. The space above the tongue 1 is filled with highly elastic material.

One buffer 16 can be adjustable in terms of its elasticity. On the other hand, it can also be omitted. In this case, however, the stringer 4 should be intrinsically elastic. It is also possible that, in the basic position of the board, there is such a distance between the stringer 4 and the bearing 20 or the buffer 16 that, in an initial bending range of the tongue, the bending and torsional forces are exerted solely by the tongue, and the stringer and stop surface serve as bending-limitation means.

FIGS. 6 and 7 illustrate an embodiment wherein an aft corresponding to the design according to the invention has been added subsequently to a surfboard of conventional type, in which the aft has been cut off. The tongue 1 projects further forwards than the remaining part of the aft. Its projecting part is fastened to the remaining part of the surfboard by means of dowels 22. Moreover, brackets 23, to which the stringer 4 are fastened, project rearwards from this remaining part. Once again, 17 denotes plinths fixed to the tongue, 18 adjustable spring (in this case, helical springs), 19 a cross-strut and 8 a foot loop. The rear surface of the remaining part of the surfboard is provided with a layer 24 of high-strength plastic.

The stringers 4 are connected to the brackets 23 via rubber buffers 25. These buffers have the form of curved cuboids. They can be compressed by means of screws 26, in such a way that they approximate to a non-curved cuboid. The elasticity of the rubber buffers can be increased in this way.

I claim:

1. A surfboard having an aft region terminating in a flexible tongue having a top, a front and a rear end, said flexible tongue disposed on the underside of said aft region of said surfboard; an elastic covering over the top of said flexible tongue; two supports arranged in succession above said flexible tongue and oriented relative to each other in the longitudinal direction of said tongue, one of said supports being a rear vertical support located proximate the rear end of said tongue and mounted inflexibly against said tongue, the other of said supports being a front vertical support mounted inflexibly to said surfboard; and elastic means including a stringer for elastically inter connecting said two supports, said elastic means operatively cooperating with said tongue for influencing the elastic deformation of said tongue.

2. The surfboard as claimed in claim 1 wherein said stringer arranged between said two supports is formed from an elastic material.

3. The surfboard as claimed in claim 1 wherein said elastic means includes an elastic buffer element mounted between one end of said stringer and one of said supports.

4. The surfboard as claimed in claim 3 wherein said elastic buffer element is mounted proximate to said front support.

5. The surfboard as claimed in claim 1 wherein said elastic covering over the top of said flexible tongue includes an elastic material received within a space defined within said surfboard above said flexible tongue.

6. The surfboard as claimed in claim 3 further including means for adjusting the elastic characteristic of said elastic buffer element.

7. The surfboard as claimed in claim 3 wherein said elastic buffer element is arranged in front of said stringer.

8. The surfboard as claimed in claim 6 wherein said means for adjusting said elastic characteristic includes means in said elastic buffer element for receiving a tension screw for deforming said elastic buffer element.

9. The surfboard as claimed in claim 1 wherein said stringer is mounted elevated above said flexible tongue.

10. The surfboard as claimed in claim 1 wherein said front support is mounted within a portion of the surfboard forward of the flexible tongue.

11. The surfboard as claimed in claim 9, further including a plurality of plinths having two opposed ends, one end of each of said plinths being fixed to the top of said flexible tongue and extending upwardly therefrom, and the opposed ends of each of said plinths terminating at a predetermined distance from said stringer.

12. The surfboard as claimed in claim 1 further including at least one spring mounted to said surfboard and positioned between said tongue and said stringer.

13. The surfboard as claimed in claim 12 further including means for adjusting the spring characteristic of said at least one spring.

14. The surfboard as claimed in claim 13 wherein said at least one spring is a helical spring supported on its bottom by said tongue and fastened at its top to said stringer, and means for adjusting the distance between said at least one spring and said stringer.

15. The surfboard as claimed in claim 5 wherein said elastic material is foam, at least the outer pores of said foam being closed.

16. The surfboard as claimed in claim 1 further including at least two adjacent stringers extending between said forward and rear supports.

17. The surfboard as claimed in claim 16 further including at least one cross-strut located between said two adjacent stringers.

18. The surfboard as claimed in claim 17 further including a foot loop attached to said at least one cross-strut.

19. The surfboard as claimed in claim 17 wherein said cross-strut is mounted sufficiently loose to said two stringers to enable said tongue to bend and twist within predetermined limits.

20. The surfboard as claimed in claim 1, wherein said front vertical support is mounted to said tongue proximate the forward end of said tongue.

21. The surfboard as claimed in claim 1, wherein said front vertical support is mounted to said surfboard in front of the forward end of said tongue.

* * * * *